United States Patent [19]

Saldarriaga et al.

[11] 4,152,805

[45] May 8, 1979

[54] BROOM COVER

[76] Inventors: Nydia Saldarriaga, 48-15 59th St., Woodside, N.Y. 11377; Gregorio Aragon, 40-13 80th St., Elmhurst, N.Y. 11373

[21] Appl. No.: 879,207

[22] Filed: Feb. 21, 1978

[51] Int. Cl.[2] ..... A46B 17/04

[52] U.S. Cl. ..... 15/168; 15/175

[58] Field of Search ..... 15/168, 171, 174, 175, 15/189, 207, 247, 248 R; D4/4

[56] References Cited

U.S. PATENT DOCUMENTS

| | | | |
|---|---|---|---|
| 391,687 | 10/1888 | Cahill | 15/171 X |
| 947,012 | 1/1910 | Clark | 15/175 X |
| 2,070,448 | 2/1937 | Nork | 15/168 |
| 2,073,558 | 3/1937 | Linder | 15/168 |
| 3,768,111 | 10/1973 | Lees | 15/247 X |

FOREIGN PATENT DOCUMENTS

| | | | |
|---|---|---|---|
| 855042 | 2/1940 | France | 15/247 |
| 455941 | 3/1950 | Italy | 15/171 |
| 358689 | 10/1931 | United Kingdom | 15/248 R |
| 943736 | 12/1963 | United Kingdom | 15/248 R |

*Primary Examiner*—Daniel Blum
*Attorney, Agent, or Firm*—Daniel Jay Tick

[57] ABSTRACT

A sleeve-like case of pliable material covers part of the bundle of fibers of a broom next-adjacent the handle of the broom. The case has a pair of spaced opposite parallel face panels joined to each other by a pair of spaced opposite parallel side panels perpendicular to the face panels. The side panels are elastic material so that the case fits over different-sized bundles of fibers.

1 Claim, 3 Drawing Figures

BROOM COVER

BACKGROUND OF THE INVENTION

The present invention relates to a broom cover. More particularly, the invention relates to a broom cover for a broom having a broomstick with a bundle of fibers affixed to one end thereof.

Broom covers are disclosed in the Certificate of Registration of Industrial Model No. 733, Issue No. 78,194 of the Republic of Colombia of Aug. 9, 1962 and in the following United States patents. U.S. Pat. No. 399,308, issued Mar. 12, 1889 to Wright, U.S. Pat. No. 1,299,796, issued Apr. 8, 1919 to Showalter, U.S. Pat. No. 1,378,457, issued May 17, 1921 to Holland et al, U.S. Pat. No. Des. 144,971, issued June 11, 1946 to Hofmann, U.S. Pat. No. 2,674,001, issued Apr. 6, 1954 to Abrams et al, U.S. Pat. No. 3,106,738, issued Oct. 15, 1963 to Bohne and U.S. Pat. No. Des. 211,234, issued June 4, 1968 to Collings.

When a broom is used indoors it tends to strike furniture, walls, doors or other objects and may mar or damage such objects.

The principal object of the invention is to provide a broom cover for covering the upper part of the bundle of fibers of a broom to prevent it from damaging furniture or other objects which it strikes when used to sweep indoors.

An object of the invention is to provide a broom cover of simple structure, which is inexpensive in manufacture and of durable nature.

Another object of the invention is to provide a broom cover which is attractive in appearance and functions efficiently, effectively and reliably to cover part of the bundle of fibers of a broom to protect objects struck by the broom from damage.

Still another object of the invention is to provide a broom cover which is installable on, and removable from, brooms of different sizes with facility, convenience and rapidity.

BRIEF SUMMARY OF THE INVENTION

In accordance with the invention, a broom cover is provided for a broom which has a broomstick with a bundle of fibers affixed to one end thereof. The broom cover comprises a sleeve-like case of pliable material for covering part of the bundle of fibers of a broom next-adjacent the handle of the broom. The case has a pair of spaced opposite substantially parallel face panels joined to each other by a pair of spaced opposite substantially parallel side panels substantially perpendicular to the face panels. The side panels comprise elastic material whereby the case fits over different-sized bundles of fibers.

A layer of soft material lines each of the face panels of the case.

Each of the face panels of the case comprises one of a synthetic and non-synthetic material lined with a layer of soft material.

Each of the face panels of the case comprises a pliable fabric material lined with foam rubber.

The case has a substantially circular open upper end for accommodating the broomstick and a substantially elongated rectangular open lower end for accommodating the bundle of fibers.

The bundle of fibers has a predetermined length and the case has a length between one third and one half said predetermined length.

BRIEF DESCRIPTION OF THE DRAWINGS

In order that the invention may be readily carried into effect, it will now be described with reference to the accompanying drawings, wherein.

DETAILED DESCRIPTION OF THE INVENTION

Figure 1:
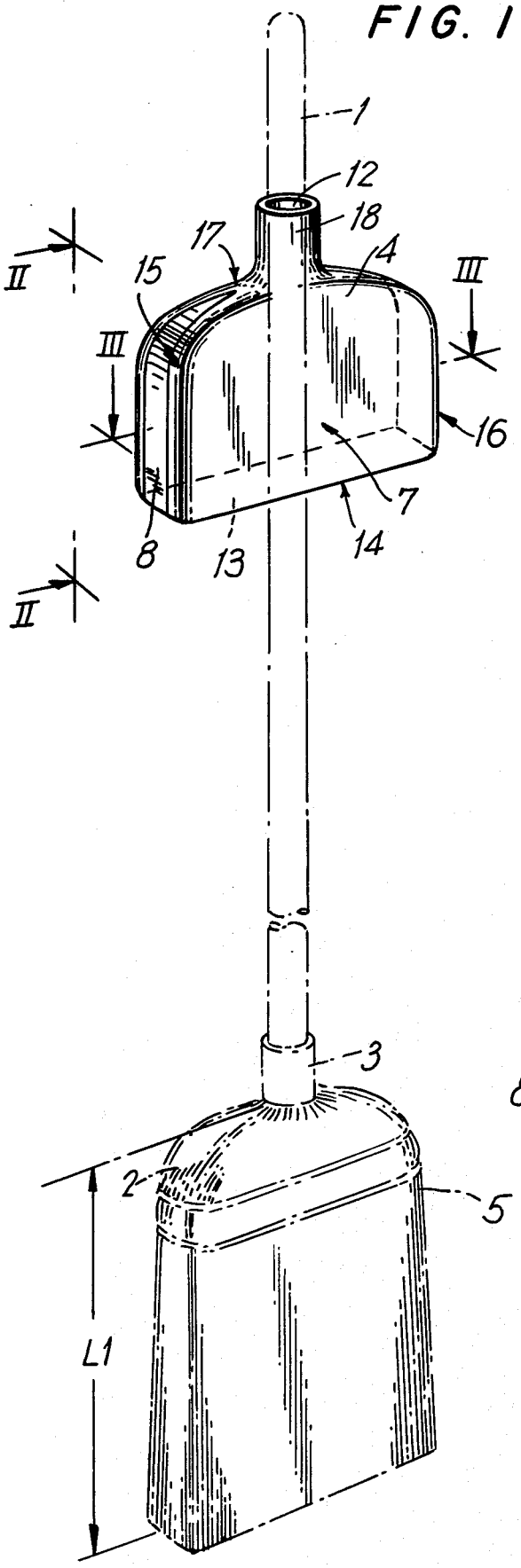
FIG. 1 is a perspective view of an embodiment of the broom cover of the invention being moved into position on a broom.

The broom cover of the invention is for a broom having a broomstick 1 with a bundle of fibers 2 affixed to one end 3 thereof, as shown in FIG. 1.

Figure 2:
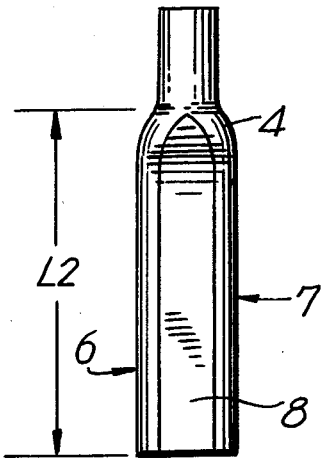
FIG. 2 is a side view, taken along the lines II—II, of FIG. 1.

The broom cover of the invention comprises a sleeve-like case 4 of pliable material (FIGS. 1 to 3) of any suitable type such as, for example, synthetic material, such as plastic or non-synthetic material, such as textile fabric.

The case 4 covers part 5 (FIG. 1) of the bundle of fibers 2 of the broom next-adjacent the handle 1 of said broom.

Figure 3:
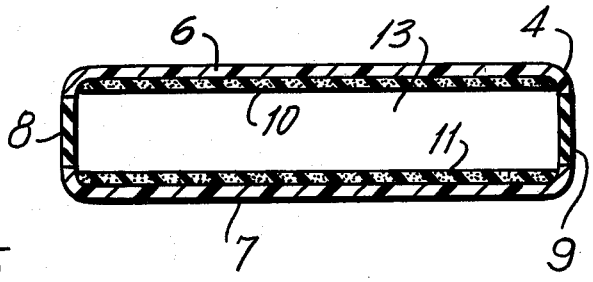
FIG. 3 is a cross-sectional view, on an enlarged scale, taken along the lines III—III, of FIG. 1.

The case 4 has a pair of spaced, opposite, substantially parallel face panels 6 and 7, respectively (FIGS. 2 and 3), joined to each other by a pair of spaced, opposite, substantially parallel side panels 8 and 9, respectively (FIG. 3). The side panels 8 and 9 are substantially perpendicular to the face panels 6 and 7 and comprise elastic material of any suitable type such as, for example, rubber or rubberized material.

The elastic side panels 8 and 9 permit the case 4 to fit over different-sized bundles of fibers and thereby to fit on different-sized brooms.

A layer of soft material such as, for example, foam rubber, lines each of the face panels 6 and 7 of the case 4. Thus, as shown in FIG. 3, a layer of soft material 10 lines the face panel 6 and a layer of soft material 11 lines the face panel 7.

The case 4, as shown in FIG. 1, has a substantially circular open upper end 12 for accommodating the broomstick 1. The case 4 has a substantially elongated rectangular open lower end 13 (FIGS. 1 and 3) for accommodating the bundle of fibers 2.

The bundle of fibers 2 has a predetermined length L1 (FIG. 1) and the case 4 has a length L2 (FIG. 2) between one third and one half said predetermined length.

Each of the face panels 6 and 7 of the case 4, as shown in FIG. 1, has a generally rectangular shape, with a substantially linear bottom edge and a pair of substantially linear spaced parallel side edges extending substantially perpendicularly from said bottom edge. A curvilinear top edge extends from the side edges and narrows, at its central area, into a neck. The bottom edge 14, the side edges 15 and 16, the top edge 17 and the neck 18 of the face panel 7 are shown in FIG. 1.

While the invention has been described by means of a specific example and in a specific embodiment, we do not wish to be limited thereto, for obvious modifications will occur to those skilled in the art without departing from the spirit and scope of the invention.

We claim:

1. A broom cover for a broom having a broomstick with a bundle of fibers affixed to one end thereof, said broom cover comprising a sleeve-like case for covering part of the bundle of fibers of a broom next-adjacent the handle of the broom, said case having a pair of spaced opposite substantially parallel face panels of pliable fabric material lined with foam rubber joined to each other by a pair of spaced opposite substantially parallel side panels substantially perpendicular to said face panels, the material of said side panels being different from that of said face panels and comprising elastic material whereby said case fits over different-sized bundles of fibers, and wherein said case has a substantially circular open upper end in the form of a neck for accommodating the broomstick and a substantially elongated rectangular open lower end for accommodating the bundle of fibers.

* * * * *